United States Patent [19]

Williams et al.

[11] Patent Number: 4,938,165

[45] Date of Patent: Jul. 3, 1990

[54] MOUNTING OF TRANSDUCER IN A BOAT HULL

[75] Inventors: Phillip L. Williams, Chouteau; John V. Wallace, Skiatook; Roy E. Stiner, Tulsa, all of Okla.

[73] Assignee: Lowrance Electronics, Inc., Tulsa, Okla.

[21] Appl. No.: 205,213

[22] Filed: Jun. 10, 1988

[51] Int. Cl.[5] ..... G01C 21/00

[52] U.S. Cl. ..... 114/343; 264/278

[58] Field of Search ..... 114/343, 270; 73/186; 264/278

[56] References Cited

U.S. PATENT DOCUMENTS

| | | | |
|---|---|---|---|
| 1,290,448 | 1/1919 | Whiteley, Jr. . | |
| 1,866,643 | 7/1932 | Greear | 114/185 |
| 1,994,236 | 3/1935 | Laer | 114/185 |
| 3,067,714 | 12/1962 | Allmand | 114/185 |
| 3,207,466 | 9/1965 | Vance | 249/85 |
| 3,400,683 | 9/1968 | Forest | 114/185 |
| 3,797,442 | 3/1974 | McRae | 114/197 |
| 3,956,785 | 5/1976 | Halfon | 114/39.1 |
| 4,019,454 | 4/1977 | Landwerlen | 114/197 |
| 4,106,745 | 8/1978 | Carrow | 264/278 |
| 4,531,922 | 7/1985 | Schutz | 441/74 |
| 4,534,307 | 8/1985 | Overs | 114/343 |

*Primary Examiner*—Joseph F. Peters, Jr.

*Assistant Examiner*—Jesûs D. Sotelo

*Attorney, Agent, or Firm*—Larson and Taylor

[57] ABSTRACT

A method for mounting a transducer in a boat hull is disclosed where the transducer has a frusto-conical outer end portion adjacent an end which is to be mounted flush with the boat hull. Initially, a member is positioned at a predetermined location in the boat hull mold, which member includes an upwardly converging frusto-conical surface. The boat hull is then molded around the member and the molded boat hull removed from the mold. The transducer is then attached to the portion of the boat hull which was molded about the member. In one embodiment, the member is a plug and the plug is mounted to the hull mold so that the removing of the boat hull from the hull mold also includes the removing of the boat hull from the member. The plug can have a thickness greater than the boat hull, or less than the boat hull in which case a subsequent cylindrical hole is drilled in order to attach the transducer. In an alternative embodiment, the member is a collar having a cavity therein which receives the transducer. During the molding step, the collar is bonded to the boat hull so that the transducer is attached to the collar and hence to the boat hull after removal of the boat hull from the hull mold. If desired, an alignment element can also be provided on the transducer and a mating element provided in the boat hull.

18 Claims, 2 Drawing Sheets

MOUNTING OF TRANSDUCER IN A BOAT HULL

FIELD OF THE INVENTION

The present invention relates generally to a method and apparatus for installing a transducer in a boat hull, and more particularly to a simplified method and apparatus for installing a transducer in a boat hull with the transducer in the most effective position.

BACKGROUND OF THE INVENTION

Typically, transducers are provided in a boat hull for measuring characteristics of the water or of the boat performance. Such characteristics include water depth, water temperature, speed through the water, as well as others. However, there have been problems with all previous methods of mounting such transducers.

One method of mounting a transducer to a boat hull such as a sonar transducer on a fiberglass or plastic boat consists of epoxying the transducer to the inside of the hull. This mounting method relies on the sonar signal to travel through the fiberglass or plastic and into the water. In order to be effective, it is important that no air bubbles, floatation materials (such as wood or plastic foam) or discontinuities be present in the hull at the installation area as well as that a solid bond of the transducer to the hull be provided. Because of this, proper installation is critical and many times is less than optimally achieved. It is also a disadvantage of this method that it is difficult to replace a faulty transducer.

A second method of mounting a transducer to a boat hull requires a hole to be drilled through the boat hull. Fairing blocks are then used to mount the transducer to the hull with the end of the transducer extending beyond the bottom of the hull underneath the fairing block. Unfortunately, the protrusion of the transducer affects the hull performance somewhat. In addition, the transducer is easily susceptible to damage in this position.

Another method of mounting a transducer to a hull is through a countersunk hole drilled in the hull in which a correspondingly shaped flush mount transducer is provided. While such a flush mount transducer does not affect hull performance and is not susceptible to damage, this installation method is labor intensive and requires skilled craftsmanship and a special countersinking tool. The transducer must also either be bonded to the hull through the hole or a sea trunk bonded to the hull through this hole and the transducer then mounted in the sea trunk with a suitable nut. By the use of the sea trunk, the transducer can be changed from the inside of the hull.

Still another method of mounting a transducer to a hull is to mount the transducer to the transom of the boat. Unfortunately, such a transducer mounting leaves the transducer susceptible to damage and if on the bottom of the boat affects hull performance.

Another problem with the transducer mounting methods discussed above is that the transducers are typically installed by riggers at a boat dealer or even by the customer. Usually, such people are not proficient at transducer installation and do not know the proper location for the transducer for a particular boat in order to achieve optimum performance in that boat.

Various types of collar structures which are mounted in boat hulls to provide through hull openings for mounting plugs and the like are disclosed in the following U.S. Pat. Nos.: 1,866,643 (Greear); 1,994,236 (Laer); 3,067,714 (Allmand); 3,400,683 (De Forest); 3,797,442 (McRae); 4,019,454 (Landwerien). An adaptor for installing marine transducers in an opening formed in the hull is also disclosed in U.S. Pat. No. 4,534,307 (Overs).

Other U.S. patents of interest which disclose the molding of an element in a mold for a boat or some other structure are disclosed in the following patents: U.S. Pat. Nos. 4,531,922 (Schutz); 3,208,466 (Vance); 1,290,448 (Whiteley, Jr.). U.S. Pat. No. 3,956,785 (Halfon) also discloses a plastic boat having a molded cleat which is fitted with countersunk bore holes.

SUMMARY OF THE INVENTION

In accordance with the present invention, a method for mounting a transducer in a boat hull is provided where the transducer has a frusto-conical outer end portion which converges from a bottom toward a central shank. It should be appreciated that the bottom of the transducer is designed to be flush mounted with a bottom surface of the boat hull. In the method, a member having a lower end in contact with a boat hull mold is positioned at a predetermined location in the boat hull mold. This predetermined position is the idealized location for the transducer. The member has a lower end with an upwardly converging frusto-conical surface which is substantially the same as the frusto-conical surface of the outer end portion of the transducer. The boat hull is then molded in the hull mold and about the member. Next, the molded boat hull is removed from the mold and the transducer is then attached to the portion of the boat hull which was molded about the member.

In a first embodiment of the present invention, the member is a plug which has a lower outer surface forming the frusto-conical surface. This plug is mounted to the hull mold so that when the boat hull is removed from the hull mold, the boat hull is also removed from the member and a frusto-conical cavity is thus left in the bottom surface of the boat hull. Preferably, the plug is coated with a substance which prevents the bonding of the boat hull to the plug during the molding step.

In one preferred embodiment, the plug has a height less than the thickness of the boat hull. Thus, when the transducer is attached to the boat hull, the step of drilling a hole in the boat hull through the cavity formed by the plug is necessary. This hole is sized to receive the shank of the transducer.

In another preferred embodiment, the plug has a height greater than the thickness of the boat hull. With this embodiment, the plug has an upper outer surface which is substantially the same size as the shank of the transducer. Thus, when the boat hull is removed from the mold and plug, the cavity formed by the plug member extends all the way through the boat hull.

In still another preferred embodiment of the present invention, the member is a collar having a cavity therein such that the frusto-conical surface is provided on the wall of the collar defining the cavity. The molding step then includes the step of bonding the collar to the boat hull. When attaching the transducer to the boat hull, the transducer is attached to the collar and thus to the boat hull. The collar also preferably includes a hole therethrough in the cavity. The transducer is then attached to the collar by inserting the shank of the transducer through the hole. The outer surface of the collar is also preferably provided with lock elements so that the boat hull is securely molded about the lock elements to securely hold the collar in place.

In a further preferred embodiment of the present invention, the transducer is provided with an alignment element. In the molding step, a mating alignment element is also provided in the boat hull for the alignment element of the transducer. Thus, when the transducer is attached to the boat hull, the transducer is properly aligned where this is desired.

It is an object of the present invention to provide a mounting hole in a boat hull for a flush mount transducer. The flush mount transducer according to the present invention does not increase water drag on the hull. In addition, the transducer is in direct contact with the water for most efficient operation and is not easily damaged when the boat hits objects in the water.

It is also an object of the present invention to provide a mounting for a transducer which is formed at a predetermined location and in which the transducer is simply mounted.

It is another object of the present invention to provide a mounting for a transducer in a boat hull in which special tools are not required for the mounting, and in particular a special countersunk hole need not be drilled which is difficult to do and time consuming.

It is a further object of the present invention to provide a transducer mounting in which the transducer is not only simply mounted to the boat hull, but can be simply replaced if the transducer ceases functioning or it is desired to be replaced with a new transducer for measuring different or additional characteristics.

Still another object of the present invention is to provide an alignment mechanism for transducers which require a particular orientation in the boat. This alignment mechanism allows the transducer to be installed in only one position, so that the misalignment of the transducer by the installer is not possible.

Other features and objects of the present invention are stated in or apparent from a detailed description of presently preferred embodiments of the invention found hereinbelow.

DETAILED DESCRIPTION OF THE PREFERRED EMBODIMENTS

Figure 1:
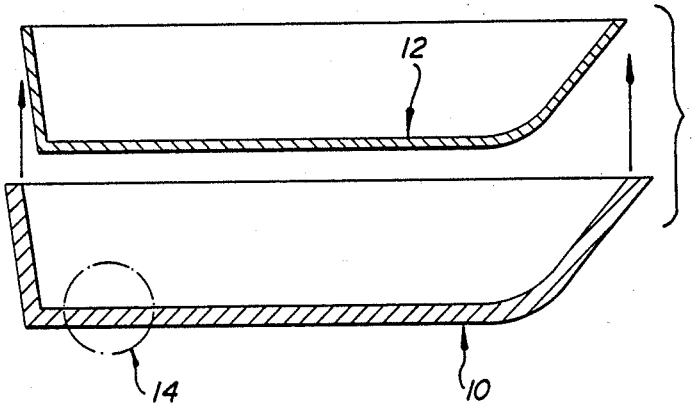
FIG. 1 is a schematic cross-sectional view of a boat hull and mold.

With reference now to the drawings in which like numerals represent like elements throughout the several views, a boat hull mold 10 is depicted in FIG. 1. As shown by the arrows, a fiberglass boat hull 12 has been molded in hull mold 10 and lifted therefrom. Also shown in FIG. 1 is an area 14 of boat hull mold 10. Area 14 is a typical predetermined desired location for a member to be provided on boat hull mold 10 in order that a transducer can be provided at a predetermined optimal position in boat hull 12.

Figure 2A:
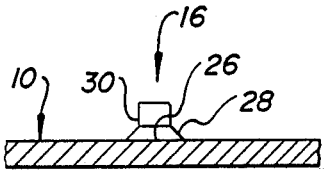
FIGS. 2A–2D are schematic cross-sectional views of the molding steps according to a first embodiment of the present invention.

In a first embodiment of the present invention, the member provided on boat hull mold 10 in area 14 is a plug 16 as shown in FIG. 2A. In this embodiment, plug 16 is substantially the same size as a flush mount transducer 18 to be provided in boat hull 12 as shown in FIG. 2D. Transducer 18 includes a frusto-conical outer end portion 20 which converges from a bottom 22 toward a central shank 24. Similarly, plug 16 includes a lower end 26, a frusto-conical surface 28, and an upper outer surface 30 which is cylindrical.

Initially, plug 16 is attached to area 14 of boat hull mold 10, either permanently or removably as desired. Temporary adhesive (i.e., double-faced tape) can be used for temporary mounting, while a glue or the like used for permanent mounting. Plug 16 is also preferably coated with a substance which keeps it from bonding to the boat hull to be molded.

Figure 2B:
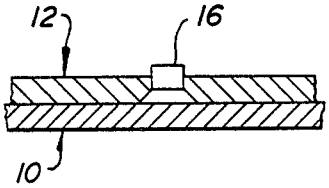

Next, as shown in FIG. 2B, boat hull 12 is molded in boat hull mold 10 in the manner well known to those of ordinary skill in the art. This generally includes the spraying of an outside gelcoat into the mold and the laying in of layers of fiberglass. As shown, the thickness of boat hull 12 is less than the height of plug 16.

Figure 2C:
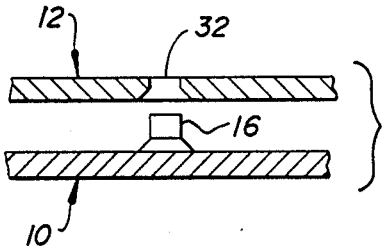
Figure 2D:
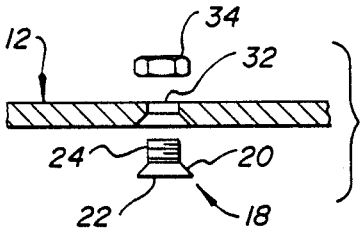

Depicted in FIG. 2C is the initial raising of boat hull 12 out of boat hull mold 10. As shown, a cavity 32 complementary to plug 16 is formed in boat hull 12.

As cavity 32 is complementary shaped to plug 16, cavity 32 is also complementary shaped to transducer 18. Thus, as shown in FIG. 2D, transducer 18 is simply mounted in cavity 32 by inserting shank 24 through cavity 32 until frusto-conical outer end portion 20 of transducer 18 engages boat hull 12. Then, where shank 24 is provided with screw threads, a suitable nut 34 is threaded onto shank 24 to secure transducer 18 to boat hull 12. As will be appreciated by those of ordinary skill in the art, some sealing is generally provided about transducer 18. This sealing can take the form of caulking around frusto-conical outer end portion 20, O-rings, compression fits, or the like.

By the use of mounting nut 34, it should be appreciated that transducer 18 is easily replaced if desired. Furthermore, if it is not desired to provide a transducer with boat hull 12, a simple flush mounted blank can be mounted in place of transducer 18. Then, if at a later date a transducer is desired, the blank can be removed and the transducer simply installed on boat hull 12.

Depicted in FIGS. 3A–3D is an alternative embodiment of the present invention similar to that described above. However, in this embodiment of the invention, a plug 40 is provided on boat hull mold 10 and is attached thereto. Plug 40 includes only a lower end 42 and a frusto-conical surface 44. Plug 40 also includes an upper end 46 at the center of which is a protruding tip 48.

Figure 3A:
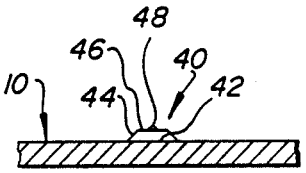
FIGS. 3A–3D are schematic cross-sectional views of the molding and mounting steps according to a second embodiment of the present invention.
Figure 3B:
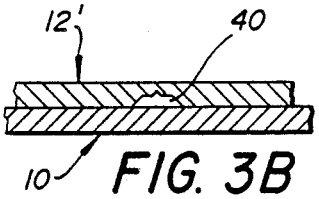
Figure 3C:
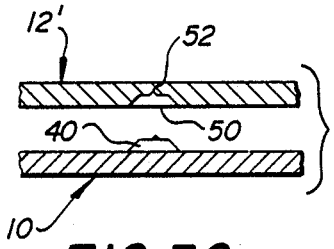
Figure 3D:
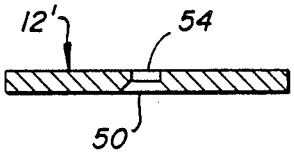

As best appreciated in FIG. 3B, plug 40 has a height which is less than the thickness of boat hull 12'. Thus, during forming, boat hull 12' extends above and around plug 40.

When boat hull 12' is removed from boat hull mold 10, a cavity 50 is provided which is complementary to plug 40. Cavity 50 includes a slight central indentation 52 formed by tip 48 of plug 40.

In order to mount a transducer in boat hull 12', a cylindrical hole 54 is simply drilled in boat hull 12'. Hole 54 is easily drilled by use of indentation 52 as a starting location and assures that hole 54 is properly centered in cavity 50. The transducer is then simply mounted in cavity 50 in the same manner as described above with respect to transducer 18 using nut 34.

Figure 4:
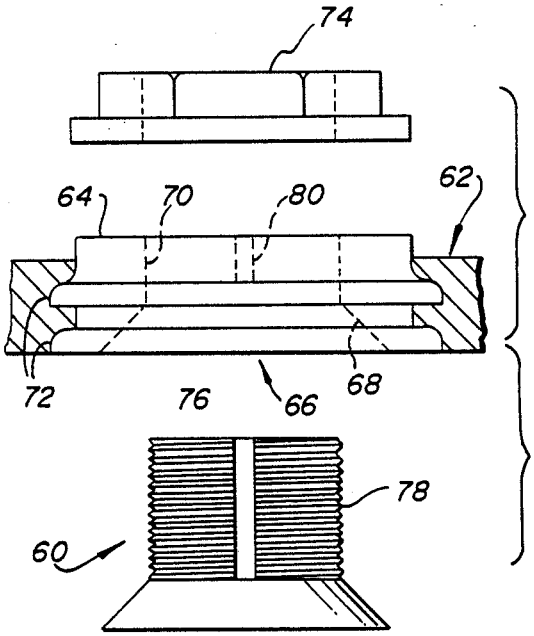
FIG. 4 is a schematic elevation view of a collar and transducer provided with alignment elements according to a third embodiment of the present invention.
Figure 5:
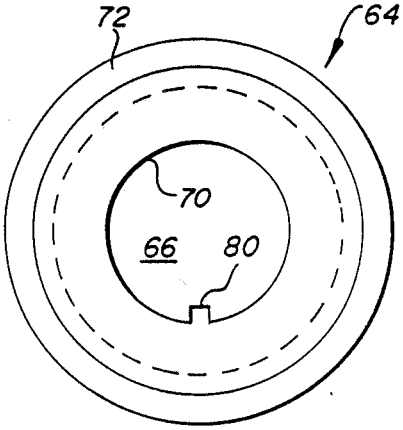
FIG. 5 is a top plan view of the collar depicted in FIG. 4.

Depicted in FIGS. 4 and 5 is still another alternative method for mounting a transducer 60 in a boat hull 62. This method makes use of a collar 64. Collar 64 includes a cavity 66 having a frusto-conical surface 68 on the wall of cavity 66. In addition, a cylindrical surface 70 is also provided above frusto-conical surface 68. On the outside of collar 64, lock elements 72 are provided.

In order to mount transducer 60 to boat hull 62, collar 64 is initially positioned in boat hull mold 10 at area 14. However, instead of attaching collar 64 to boat hull mold 10 as was done with plugs 16 and 40 discussed above, collar 64 is not attached. Thus, as boat hull 62 is molded in boat hull mold 10, boat hull 62 forms around collar 64. This causes collar 64 to be securely bonded to boat hull 62. The bonding of boat hull 62 to collar 64 is enhanced by the use of lock elements 72.

As shown in FIG. 4, the height of collar 64 is larger than the thickness of boat hull 62, so that collar 64 extends above boat hull 62. In order to mount transducer 60 to boat hull 62, transducer 60 is simply inserted through cavity 66 of collar 64 and a nut 74 attached thereto. As with transducer 18, a suitable sealing is also provided to prevent leakage past transducer 60.

In the embodiment of the invention depicted in FIGS. 4 and 5, an alignment means is also provided for transducer 60. This alignment means takes the form of a keyway 76 provided in shank 78 of transducer 60. Keyway 76 is provided when transducer 60 is desired to be oriented in a particular direction with respect to the longitudinal axis of the boat. For example, keyway 76 can be provided along the forward edge of shank 78 where the forward edge is desired to be facing the direction of travel of the boat. Where transducer 60 is provided with keyway 76, collar 64 is provided with a corresponding key 80 as shown. With key 80, transducer 60 can only be inserted in cavity 66 when keyway 76 receives key 80.

Although the use of a keyway and key aligning means has been shown with respect to the FIGS. 4 and 5 embodiment utilizing collar 64, it should be appreciated that a key 80 can also be formed in cavity 32 of the first embodiment by providing plug 16 with a suitable key forming cavity. Thus, the first two above-mentioned embodiments can also make use of the disclosed aligning means.

While the present invention has been described for the installation of a transducer by the manufacturer, a transducer need not necessarily installed by the manufacturer. For example, if the manufacturer is not certain that a transducer will be desired, or which transducer will be desired, the manufacturer can simply insert a stopper member or blank having the same shape as the transducer in place of the transducer. Then, the boat dealer or seller, or even the buyer, can simply replace the stopper member with a transducer as necessary or when desired.

With any of the embodiments of the invention discussed, it should be appreciated that a transducer installation is accomplished which is easily performed by unskilled labor without special tools or the like. In addition, the transducer is optimally located along the boat and flush mounted so as not to affect the movement of the boat through the water. Furthermore, if a mounted transducer goes bad, that transducer is easily replaced.

While the present invention has been described above with respect to exemplary embodiments thereof, it will be understood by those of ordinary skill in the art that variations and modifications can be effected within the scope and spirit of the invention.

We claim:

1. A method for mounting a transducer in a beat hull where the transducer has a frusto-conical outer end portion which converges from a bottom toward a central shank and which bottom is designed to be flush mounted with a bottom surface of the boat hull, the method comprising:

positioning a plug at a predetermined location in a boat hull mold, the plug having a lower end in contact with the hull mold and a lower outer surface upwardly converging therefrom forming a frusto-conical surface substantially the same as the frusto-conical surface of the outer end portion of the transducer, said positioning step including the step of mounting the plug to the hull mold;

molding a boat hull in the hull mold and about the plug;

removing the molding boat hull from the mold, said removing step including the step of removing the plug from the boat hull as the boat hull is removed from the hull mold to leave a frusto-conical cavity in the bottom surface of the boat hull; and attaching the transducer to the portion of the boat hull which was molded about the plug.

2. A method for mounting a transducer in a boat hull as claimed in claim 1 and further including the step of coating the plug with a substance which prevents bonding of the boat hull to the plug during the molding step.

3. A method for mounting a transducer in a boat hull as claimed in claim 1 wherein the plug has a height less than a thickness of the boat hull; and wherein said attaching step includes the step of drilling a hole in the boat hull through the cavity in which hole the shank of the transducer is received.

4. A method for mounting a transducer in a boat hull as claimed in claim 1 wherein the plug has a height greater than the thickness of the boat hull and includes an upper outer surface substantially the same size as the shank of the transducer; and wherein the removing of the plug step leaves a hole through the boat hull in the cavity which was formed by the upper outer surface of the plug.

5. An apparatus for mounting a transducer in a boat hull where the transducer has a frusto-conical outer end portion which converges from a bottom toward a central shank and which bottom is designed to be flush mounted with a bottom surface of the boat hull, the apparatus comprising:

a collar which is molded in the bottom of the boat hull to be flush with the bottom of the boat hull, said collar having a cavity therethrough which is defined by (a) a frusto-conical surface at a lower end of said cavity which said frusto-conical surface matingly receives the frusto-conical outer end portion of the transducer, (b) a cylindrical surface at an upper end of said cavity which said cylindrical surface matingly receives a portion of the shank of the transducer, (c) an outer surface about which the boat hull is molded, and (d) a protrusion from said outer surface which securely holds said collar in the boat hull; and a nut which is located above said collar and which threadably receives a portion of the shank of the transducer extending above said collar such that said nut is advanced along the shank until said nut engages said collar to hold the transducer in place in said collar and hence to the boat hull.

6. An apparatus for mounting a transducer in a boat hull as claimed in claim 5 wherein there is a plurality of said protrusions.

7. An apparatus for mounting a transducer in a boat hull as claimed in claim 5 wherein the shank of the transducer is provided with an alignment keyway; and wherein said cylindrical surface is provided with a key which is received in the keyway to align the transducer in the boat hull.

8. A method for mounting a transducer in a boat hull where the transducer has a frusto-conical outer end portion which converges from a bottom toward a central shank and which bottom is designed to be flush mounted with a bottom surface of the boat hull, the method comprising:

positioning a collar at a predetermined location in a boat hull mold, the collar having a lower end in contact with the hull hold and a cavity therein whereby an upwardly converging frusto-conical surface is provided on the wall of the collar defining the cavity substantially the same as the frusto-conical surface of the outer end portion of the transducer, the collar also having an outer surface provided with lock elements;

molding a boat hull in the hull mold and about the collar and lock elements to thereby bond the collar to the boat hull;

removing the molded boat hull from the mold; and attaching the transducer to the collar and hence to the boat hull which was molded about the collar.

9. A method for mounting a transducer in a boat hull as claimed in claim 8 wherein the transducer is provided with an alignment element; and wherein the molding step includes the step of providing a mating alignment element on the collar for the alignment element of the transducer and the attaching step includes the aligning of the alignment elements to orient the transducer in a predetermined desired orientation.

10. A method for mounting a transducer in a boat hull as claimed in claim 8 wherein the collar includes a hole therethrough in the cavity; and wherein the attaching of the transducer to the collar step includes the inserting of the shank of the transducer through the hole.

11. A method for mounting a transducer in a boat hull where the transducer has a frusto-conical outer end portion which converges from a bottom toward a central shank and which bottom is designed to be flush mounted with a bottom surface of the boat hull, and where the transducer is provided with an alignment element, the method comprising:

positioning a member at a predetermined location in a boat hull mold, the member having a lower end in contact with the hull mold which lower end has an upwardly converging frusto-conical surface substantially the same as the frusto-conical surface of the outer end portion of the transducer;

providing a mating alignment element in the boat hull for the alignment element of the transducer;

molding a boat hull in the hull mold and about the member;

removing the molded boat hull from the mold; and attaching the transducer to the portion of the boat hull which was molded about the member, including the aligning of the alignment elements to orient the transducer in a predetermined desired orientation.

12. A method for mounting a transducer in a boat hull as claimed in claim 11 wherein the member is a collar having a cavity therein such that the frusto-conical surface is provided on the wall of the collar defining the cavity;

wherein the molding step includes the step of the collar to the boat hull; and wherein the attaching step includes the step of attaching the transducer to the collar and hence to the boat hull.

13. A method for mounting a transducer in a boat hull as claimed in claim 12 wherein the collar includes a hole therethrough in the cavity; and wherein the attaching of the transducer to the collar step includes the inserting of the shank of the transducer through the hole.

14. A method for mounting a transducer in a boat hull as claimed in claim 12 wherein the collar includes an outer surface; and further including the step of providing the outer surface of the collar with lock elements such that said molding steps molds the boat hull about the lock elements to securely hold the collar in place.

15. An apparatus for mounting a transducer in a boat hull where the transducer has a frusto-conical outer end portion which converges from a bottom toward a central shank provided with an alignment keyway and which bottom is designed to be flush mounted with a bottom surface of the boat hull, the apparatus comprising:

a collar which is molded in the bottom of the boat hull to be flush with the bottom of the boat hull, said collar having a cavity therethrough which is defined by (a) a frusto-conical surface at a lower end of said cavity which said frusto-conical surface matingly receives the frusto-conical outer end portion of the transducer and (b) a cylindrical surface at an upper end of said cavity which said cylindrical surface matingly receives a portion of the shank of the transducer, said cylindrical surface being provided with a key which is received in the keyway to align the transducer in the boat hull; and a nut which is located above said collar and which threadably receives a portion of the shank of the transducer extending above said collar such that said nut is advanced along the shank until said nut engages said collar to hold the transducer in place in the collar and hence to the boat hull.

16. An apparatus for mounting a transducer in a boat hull as claimed in claim 15 wherein said collar further includes an outer surface about which the boat hull is molded, and a lock element provided on said outer surface which securely holds said collar in the boat hull.

17. An apparatus for mounting a transducer in a boat hull as claimed in claim 16 wherein said lock element extends around a periphery of said outer surface.

18. An apparatus for mounting a transducer in a boat hull as claimed in claim 17 wherein said lock element is plurality of protrusions from said outer surface.

* * * * *